US005337949A

United States Patent [19]

Seeley

[11] Patent Number: 5,337,949

[45] Date of Patent: Aug. 16, 1994

[54] PHOTO OR ART EASEL AND SELF-MAILER

[76] Inventor: Wayne C. Seeley, 233 Coventry at Waterford, York, Pa. 17402

[21] Appl. No.: 58,176

[22] Filed: May 10, 1993

[51] Int. Cl.[5] ..... A47G 1/06; G09F 1/12; B65D 27/04; B65D 27/22

[52] U.S. Cl. ..... 229/92.8; 40/152.1; 40/158.1; 229/84

[58] Field of Search ..... 40/152.1, 158.1; 229/92.8, 84

[56] References Cited

U.S. PATENT DOCUMENTS

| | | | |
|---|---|---|---|
| 944,385 | 12/1909 | Spiegel . | |
| 1,347,269 | 7/1920 | Greble . | |
| 1,421,097 | 6/1922 | Pente | 40/152.1 |
| 2,219,492 | 10/1940 | Prichap . | |
| 2,504,277 | 4/1950 | Otterson . | |
| 4,008,852 | 2/1977 | Davis . | |
| 4,167,241 | 9/1979 | Zumbrunn . | |
| 4,343,105 | 8/1982 | Isaacson . | |
| 4,640,030 | 2/1987 | Wood et al. . | |
| 4,662,093 | 5/1987 | Suttles et al. . | |
| 4,681,253 | 7/1987 | Engelhardt | 40/152.1 |
| 4,780,975 | 11/1988 | Friedman . | |
| 4,947,566 | 8/1990 | Hoebel . | |
| 5,133,496 | 0/1992 | Davidson et al. . | |

FOREIGN PATENT DOCUMENTS

| | | | |
|---|---|---|---|
| 257913 | 5/1986 | France | 40/152.1 |

*Primary Examiner*—Stephen P. Garbe
*Attorney, Agent, or Firm*—C. Hercus Just

[57] ABSTRACT

A combination photo or art easel and self-mailer comprising a main central four-sided panel having four contiguous sub-panels respectively reversibly foldably-connected to the edges of said central panel, one sub-panel having assembly instructions on one surface, an opposite sub-panel having thereon or receiving a photo or art object, a third sub-panel having securing ears tuckable into receiving slits in an opposite fourth sub-panel, whereby one surface of the assembly of folded connected panels comprises an easel showing an art view or photograph and the opposite surface of reversely-folded panels comprises an outer surface of a mailing piece. Several additional features comprise optional variations of foldable projections respectively to support the assembled panels as an easel selectively disposable upon a horizontal surface for display of a photo or art object. A modified embodiment comprises a main central four-sided panel and a pair of sub-panels respectively reversibly foldably connected to a pair of opposite edges of said central panel.

5 Claims, 3 Drawing Sheets

31
31
3
28
13
31
15
31
30
17
8
16
25
5
38
14
6
29
2
9
4
3
19
13
6
20
34
22
2
17
32
8
32
25
38
21
32
5
32
14
9
18
28
33
4

FIG. 6
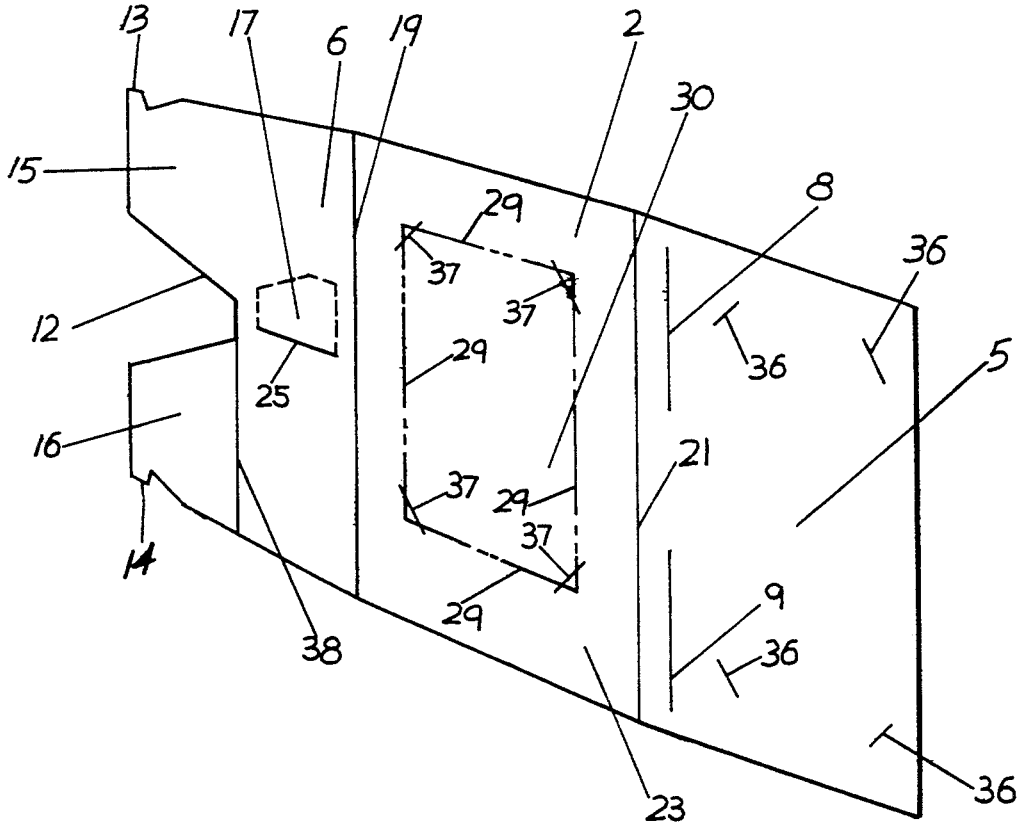
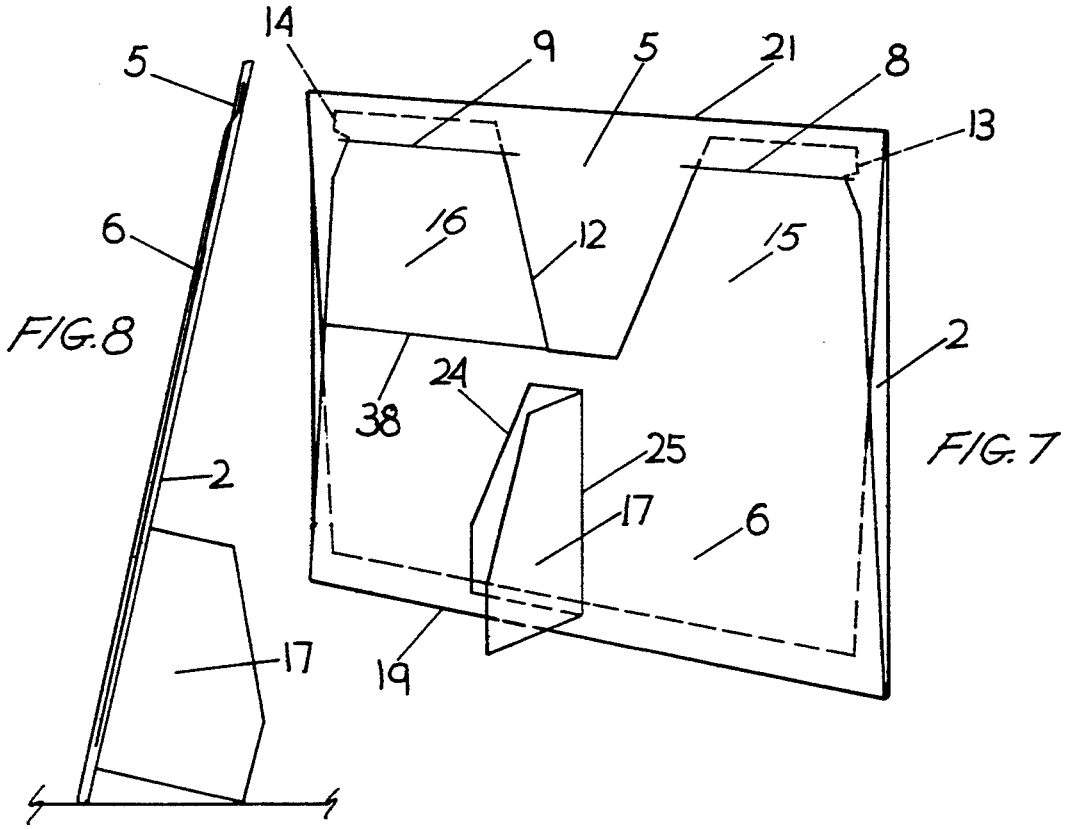
FIG. 8
FIG. 7

PHOTO OR ART EASEL AND SELF-MAILER

BACKGROUND OF THE INVENTION

The present invention pertains to a combination and convertible art object or photo display in the form of an easel or as a mailing piece composed of a central panel having four sides and a sub-panel foldably-connected respectively to each of the four edges of the central panel, such sub-panels simultaneously being reversely foldable relative to the central panel so as to dispose the assembly of panels selectively either as a display easel for an art object or photo or as a mailing piece having one surface of the central panel as an address area.

The prior patent art is somewhat replete with examples of items to display photos or art pictures when disposed in one form and also serving as a mailing piece when arranged differently. As examples of such prior art, reference is made to the following prior patents:

| | | |
|---|---|---|
| U.S. Pat. No. 944,385 | Spiegel | 1909 |
| U.S. Pat. No. 1,347,269 | Greble | 1920 |
| U.S. Pat. No. 2,219,492 | Prichap | 1940 |
| U.S. Pat. No. 2,504,277 | Otterson | 1950 |
| U.S. Pat. No. 4,008,852 | Davis | 1977 |
| U.S. Pat. No. 4,167,241 | Zumbrunn | 1979 |
| U.S. Pat. No. 4,343,105 | Isaacson | 1982 |
| U.S. Pat. No. 4,640,030 | Wood et al | 1987 |
| U.S. Pat. No. 4,662,093 | Suttles et al | 1987 |
| U.S. Pat. No. 4,780,975 | Friedman | 1988 |
| U.S. Pat. No. 4,947,566 | Hoebel | 1990 |
| U.S. Pat. No. 5,133,496 | Davidson et al | 1992 |

Among the foregoing patents, those to Spiegel, Davis and Davidson et al disclose foldable connected cards and pictures arranged for display of the pictures in a framed manner, while the remainder of the listed patents pertain to foldable card arrangements that include a panel or the like that serves as a leg to support a framed picture, or the like, in a somewhat standing position. Though the present invention pertains to the general type of card-like objects folded in various ways to display an art object or a photo or photograph, as represented by the cited prior art, the invention proposes several embodiments of foldable cardstock panels respectively capable of being used initially as a mailing piece that readily is convertable to a framed art picture or photo capable of being supported easel-like upon a horizontal surface or otherwise, as set forth in detail hereinafter.

SUMMARY OF THE INVENTION

It is among the basic principles of the invention to provide, from card stock, a central square or rectangular panel that, in one embodiment, can have an art picture printed or formed thereon, or a photo can be mounted on one face thereof, and four additional sub-panels are preferably reversibly foldably-connected respectively to the edges of the central panel, two opposite sub-panels being provided respectively with connectable ears and receiving slots or slits to secure the folded panels in the form of a mailing piece and the outer surface of the central panel is adapted to have an address inscribed thereon.

Another alternative object of the invention is to provide the central panel with a suitable area to be outlined by rows of serrations to readily enable a knock out section of said panel to be removed so the remainder of the panel may serve as a frame for an art object or photo and one of the adjacent sub-panels, when folded onto said frame, may support the art object or photo to appear within said frame.

Still another object of the invention is to provide in one embodiment thereof a rectangular central panel to which four foldable sub-panels respectively are connected for reversible folding and in which arrangement a first pair of said sub-panels are foldably-connected respectively to the longer opposite edges of the central panel and are first foldably-disposed in overlapping manner upon one surface of the central panel. One of the other sub-panels is provided with a pair of slits therein and it is foldable onto the overlying first pair of sub-panels and the remaining fourth sub-panel is folded onto the three overlying sub-panels and is provided with a pair of ears that are adapted to be tucked into said slits to secure all the overlying panels into a compact assembly selectively for mailing or to have a picture or art object displayed in a frame comprising part of the central panel.

One further object of the invention relative to certain of the foregoing objects of the invention is to provide the outermost sub-panel of a compact folded arrangement with at least one supporting ear that is formed partially by serrations or otherwise in said sub-panel to form a stand up tab or ear having a foldable connection to said outermost sub-panel, whereby said tab or ear may be folded outwardly to dispose the same perpendicular to said sub-panel and thereby permit the folded assembly to stand upright as an easel upon a supporting surface.

A still further object of the invention is to provide an embodiment thereof in which the central panel is provided with a square or rectangular pattern of connected rows of serrations defining a removable or pushout panel to permit the remainder of the central panel to serve as a frame for an art object or photo and have the corners of the latter inserted in slits into a foldable sub-panel which, when folded against the central panel, will be displayed in the frame of the latter, while the sub-panel opposite the one with the art object or photo thereon may have assembly instructions thereon, and the pair of sub-panels foldably-connected to the opposite remaining edges of the main or central panel respectively may have cooperating tongues or ears thereon and slits therein to secure the aforementioned folded sub-panels into a compact assembly respectively comprising a mailing piece or, when the sub-panels are arranged otherwise, the assembly can be used as an easel for display of an art object or photo.

One other object of the preceding object is to have the rim of the frame adjacent the art object or photo embossed to provide somewhat ornamental characteristic to the item disposed within the frame.

Details of the foregoing objects and of the invention are set forth in the following specification and are illustrated in the drawings thereof in which:

FIG. 6 is a perspective view of a still further embodiment of the invention.

FIG. 7 is a folded view of the embodiment shown in FIG. 6, illustrated in standing position.

FIG. 8 is an end view of FIG. 7.

DETAILED DESCRIPTION OF THE PREFERRED EMBODIMENTS OF THE INVENTION

Figure 1:
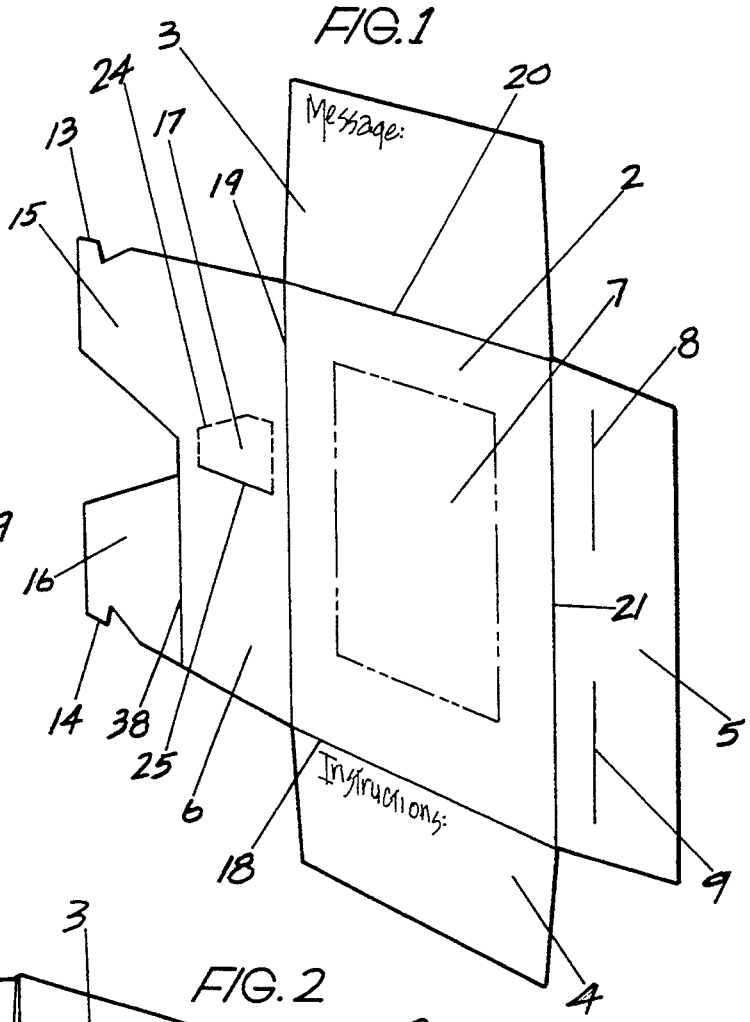
FIG. 1 is an expanded relatively flat perspective view of the principal embodiment of the invention comprising a central panel and foldably-connected sub-panels.
Figure 3:
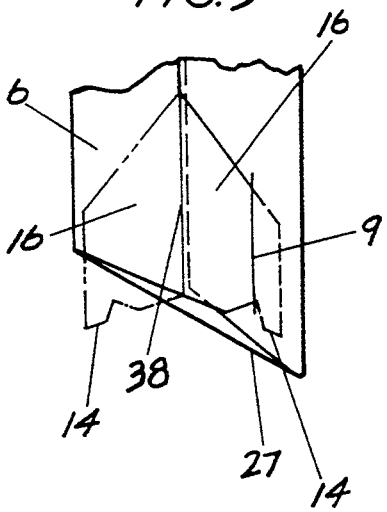
FIG. 3 is a fragmentary view illustrating one foldable ear on a sub-panel in process of being inserted in a slot in the opposite sub-panel.
Figure 2:
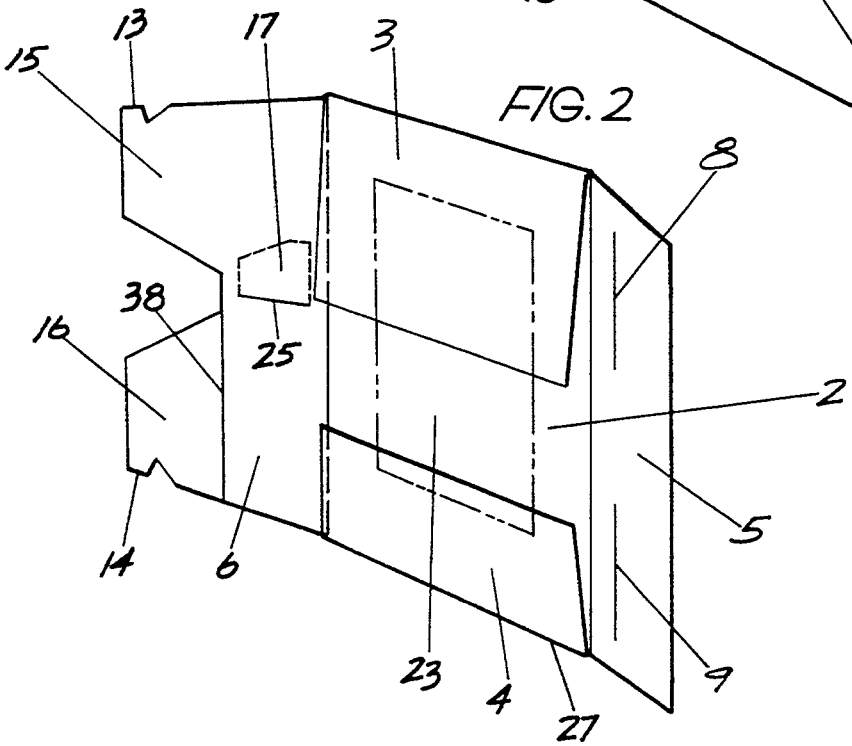
FIG. 2 is a perspective view of the embodiment shown in FIG. 1 with one opposite pair of the sub-panels shown in folded position.

Referring to FIGS. 1–3, there is illustrated therein perspective views of a combination art/easel and mailing piece consisting of a central or main four-sided preferably rectilinear stiff card panel 2, comprising a front surface 23, which is an art surface, i.e., a surface upon which an art object, such as a picture 7 is imprinted or suitably attached. Foldably-connected respectively to the edges of the central panel are four sub-panels 3, 4, 5 and 6. The connections of said sub-panels to the central panel are by suitable score lines 18, 19, 20 and 21, which preferably permit reversible folding of said sub-panels relative to the central panel for reasons set forth below.

In the situation where the sub-panels 3, 4, 5 and 6 are folded universally respectively toward an art surface or object on central panel 2, the folded combination comprises a self-mailer and, when the sub-panels are folded oppositely from that just described, the folded piece comprises an art easel display unit.

In either of the aforementioned folded situations, the folding occurs universally along the score lines 20, 18, 21 and 19 respectively. The contiguous sub-panel 6 is provided with a pair of latching tabs or ears 15 and 16, which are formed by providing a bifurcation 12, in sub-panel 6, see FIG. 6, which tabs or ears are adapted to be inserted in slits 8 and 9 in sub-panel 5, as seen in FIG. 3. It is to be noted that the tabs or ears 15 and 16, when inserted in slits 8 and 9, the sub-tabs 13 and 14 on said tabs or ears come to rest above and below the top and bottom ends of slits 8 and 9, as shown respectively in full lines in FIG. 3, this arrangement largely preventing the tabs or ears 15, 16 from becoming disengaged from said slits, especially during mailing operations. For convenience, the sub-panel 6, as shown in FIG. 1, preferably is provided with at least a weak fold line 38 to assist in inserting at least the tab or ear 16 in slit 8.

Referring to FIG. 1, it will further be seen that sub-panel 6 is formed with a standup tab or ear 17 which is partly defined by connected rows of serrations 24. Score line 25 permits outward folding of the standup tab or ear 17 to form a support when the assembly is arranged as an easel and the rectangular format is disposed with its long axis horizontal as shown in FIG. 7.

When the recipient of the art/easel receives it, they should read the instructions which appear on sub-panel 4 and are directed to remove tabs or ears 15 and 16 of sub-panel 6 from slits 8 and 9 of sub-panel 5, then read the message or greeting 26 inscribed by the sender on sub-panel 3, and proceed to do as directed by the instructions on sub-panel 4. This results in folding contiguous sub-panels 3, 4, 5 and 6 onto or toward the surface 23 of the central panel, reassemble tabs 15 and 16 with slits 8 and 9, fold standup tab 17 until perpendicular to sub-panel 6, whereby the assembly is an easel with folded edge 19 adapted to rest on a supporting surface with the long axis of panel 2 disposed horizontally, while sub-tab 14 of tab 16 is capable of also resting upon the same surface to support the easel format upright, as shown fragmentarily in FIG. 3 when tab 16 is folded on crease line 38, see FIG. 6, to extend transversely to subpanel 6, as shown in dotted lines in FIG. 3.

Figures 4, 5:
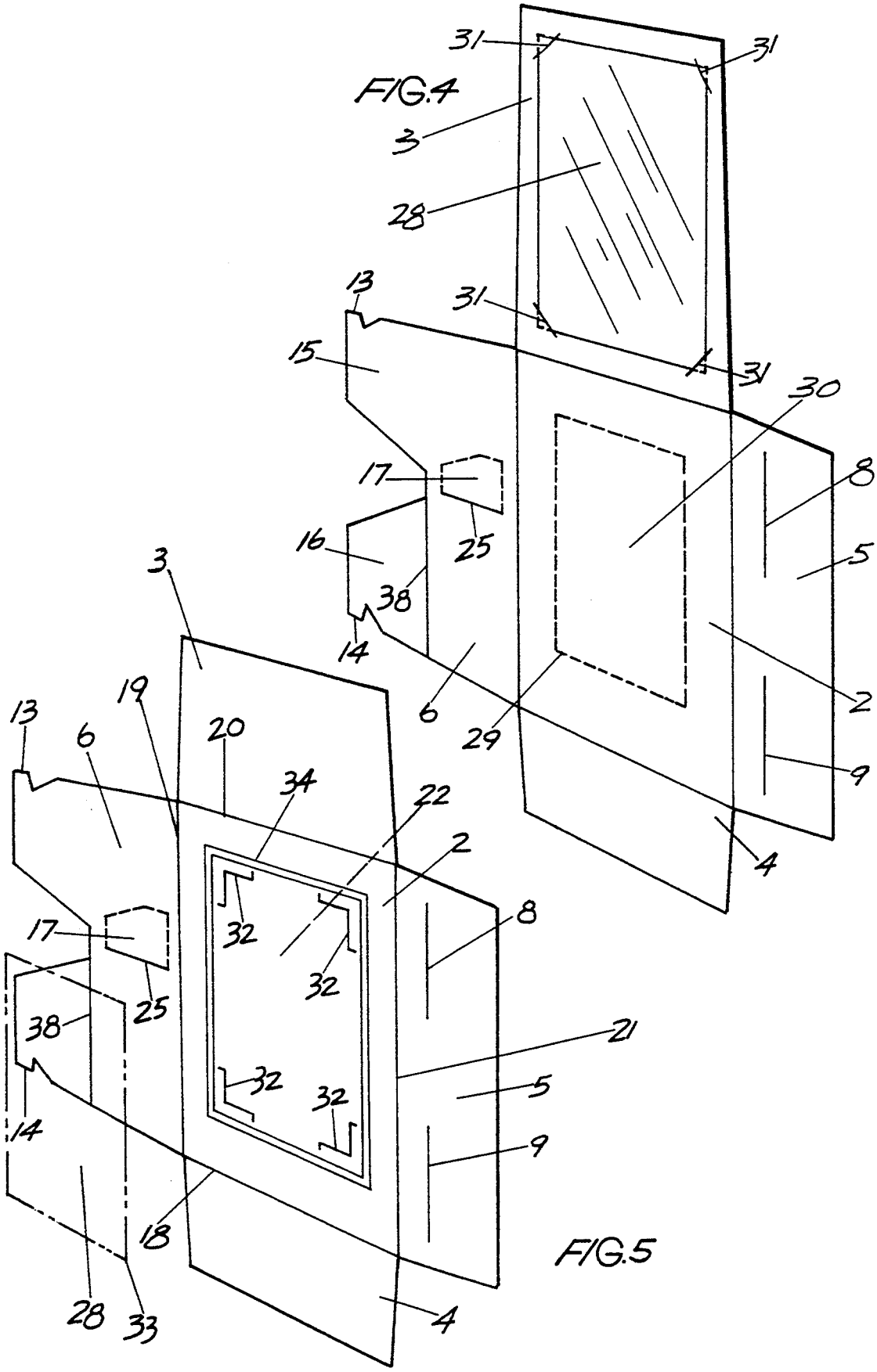
FIG. 4 is a perspective view of the invention similar to FIG. 1 but in which a different arrangement of support for an art object or photo is illustrated from that shown in FIG. 1.
FIG. 5 is a perspective view of the invention similar to FIG. 1 but in which an embossment surrounds the rim of the frame formed from the central panel.

A modified presentation piece is illustrated in FIG. 4, wherein the assembly is in the form of an easel but art object or photo 28 is not integral with central panel 2. It will be seen therein that a separate photo or art object 28 is adapted to have the corners inserted in suitably-positioned slits 31 in sub-panel 3. The central panel 2 is formed with suitable size of a removable member 30, defined by connected rows of serrations 29 which, when member 30 has been removed, forms an opening within which art object or photo 28 is displayed when sub-panel 3 is folded onto main panel 2. The presence and function of all the other sub-panels and functions for them are the same or similar to the embodiment shown in FIGS. 1–3 so as to form either a mailing piece or an easel adapted to stand upright.

Referring to FIG. 5, a still further embodiment of the invention is shown, wherein an art object or photo (not shown) is separate from the easel and is used in combination with the frame afforded by central panel 2, wherein a suitable central area 22 is defined by a set of corner slits 32, of certain desired configurations, and said area also is outlined preferably by connected indented embossments 34. The slits 32 receive the corners of an art object or photo which is then bordered by the embossment 34. As in the embodiment of FIG. 4, FIG. 5 is in other respects similar in construction and function to that of the embodiment shown in FIGS. 1–3.

In FIG. 6, still another embodiment of the invention is illustrated, wherein sub-panels 3 and 4 of the preceding figures are omitted to present a simplified version of combination art/easel and mailing piece. This version, like the preceding ones, comprises a central rectangular stiff card panel 2 to which receptive first and second sub-panels 5 and 6 are reversibly-foldably connected on score lines 21 and 19 respectively along opposite edges of central panel 2, and sub-panel 6 has a V-shaped bifurcation 12 therein to form a pair of flexible tabs or ears 15 and 16, which flexibility assists in inserting the same in slits 8 and 9, as in the preceding embodiments.

The outer edges of locking ears 15 and 16 on second sub-panel 6 are notched to provide sub-tabs 13 and 14 which, when locking ears 15 and 16 are inserted in slits 8 and 9 in first sub-panel 5, said sub-tabs will extend beneath the first sub-panel 5 when in folded position and thereby cause locking said ears in assembled position, as fragmentarily shown in FIG. 3 and described hereinabove.

In this embodiment, the central panel 2 is provided with connected lines of serrations 29, as in FIG. 4, to form a knockout panel or removable member 30. When removed, an opening is provided through which may be viewed either an art item, which may be printed upon one surface of sub-panel 5, shown in FIG. 6. If desired, a series of four diagonal slits 37 are formed in central panel 2 to define supplemental means to receive the corners of an art object of photo but such slits are only employed for the stated purpose when member 30 is intact with central panel 2. Similarly, in sub-panel 5, diagonal slits 36 are formed therein to define the corners of a square or rectangle and into which the corners of an art object or photo of complementary size can be received in the slits 36 and the inserted piece may be viewed through the opening formed in central panel 2 when the knockout panel 30 has been removed from the central panel 2 and the photo or art object, held by slits 36 on the illustrated surface of the sub-panel, whereby, when said sub-panel 5 is folded onto central panel 2, the item held by slits 36 will be seen through the opening in central panel 2.

Under the circumstances last described, the folded arrangement comprises an easel and, when standup tab 17 is separated along the lines of serration shown in FIG. 6 and the partially-separated tab 17 is folded along score line 25, the tab 17 is moved outwardly to a perpendicular relation with panel 6, and the arrangement comprises an easel for the object held by slits 37 or printed upon the surface of panel 5 illustrated in FIG. 6. Before the knockout panel 30 is removed from central panel 2, the surface 22 thereof, opposite that shown in FIG. 6, will comprise the address surface for a compact mailing piece comprising the several folded panels and sub-panels secured by the connected tabs 15 and 16 which are lockably received in slits 8 and 9 and the sub-tabs 13 and 14 secure the assembly in secure arrangement for mailing.

With respect to standup tab 17, it will be noted that its lowermost edge in subpanel 6 is spaced a limited distance above the score line 19. This is for the purpose of causing the folded assembly of the various panels shown in FIG. 7 to stand vertically along score line 19 slightly slanted backward at the top due to the extreme pointed end or tip 17*a* of standup tab 17 being slightly above a supporting plane perpendicular to the plane of the folded assembly of panels shown in FIG. 7. As a result of this, when the folded assembly of panels in FIG. 7 is made to stand upright on a horizontal surface, the assembly will lean slightly backward at the top until the tip 17*a* touches the same horizontal surface as that on which the edge 19 rests.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An art easel and self-mailing assembly comprising in combination, a. a central four-sided panel having at least a pair of opposite sub-panels of similar width connected respectively and foldably to two opposite edges of said central panel, said sub-panels respectively comprising b. a first sub-panel connected to one edge of said central panel and adapted to be folded onto one surface of said central panel, c. a second sub-panel foldably-connected to the opposite edge of said central panel, d. said central panel having a smaller panel section thereof outlined by connected lines of serrations adapted to permit said smaller panel section to be removed from said central panel to form an opening adapted to permit a photo or art object when positions on said first panel to be exposed therethrough, e. said second sub-panel having a bifurcation extending inward from the outermost edge thereof opposite the folded edge thereof to provide a pair of locking tabs rendered readily flexible by said bifurcation, and f. said first sub-panel having a pair of slits complementary in location to receive the ends of said locking ears on said second sub-panel when said second sub-panel is folded flat onto said first sub-panel and thereby form a framed art object or photo.

2. The assembly according to claim 5 further including in said central panel a series of diagonal slits spaced inwardly even distances from the corners thereof and adapted to receive respectively the corners of a photo or art object when said sub-panels have been arranged for the aforesaid assembly to comprise an easel when said smaller panel section is intact in said central panel.

3. The assembly according to claim 1 in which said locking ears are each notched at one outer edge to form sub-tabs arranged to extend beneath the folded first sub-panel when the locking ears are disposed in the slits of said first sub-panel and thereby provide locking assurance for the first and second sub-panels when the same are folded upon said central panel as aforesaid.

4. The assembly according to claim 1 further including in said second sub-panel a pattern of connected short rows of serrations defining a standup tab and having a folding score-line in said sub-panel along one edge of said tab, whereby when said serrations have been broken to form said standup tab, said tab can be folded along said scoreline to dispose said tab substantially perpendicular to the plane of said second sub-panel and thereby adapt said assembly to be stood horizontally and substantially upright upon a horizontal supporting surface.

5. The assembly according to claim 1 further including in said second sub-panel a scoreline spaced inwardly from the outer end of one of said locking ears and parallel to the foldable connection of said second sub-panel to said central panel, thereby rendering said one of said locking ears foldable to a substantially perpendicular disposition to one outer surface of the folded assembly of sub-panels and serve as a standup ear when said assembly is positioned vertically and is to be used as an easel.

* * * * *